US008944118B2

(12) United States Patent
Nalbandian

(10) Patent No.: US 8,944,118 B2
(45) Date of Patent: Feb. 3, 2015

(54) EQUILIBRIUM PRESSURE FILLING METHOD FOR FILLING PRE-PRESSURIZED AEROSOL CANS WITH BARRIER SYSTEM

(76) Inventor: Raffi Nalbandian, Richmond Hill (CA)

( * ) Notice: Subject to any disclaimer, the term of this patent is extended or adjusted under 35 U.S.C. 154(b) by 1015 days.

(21) Appl. No.: 12/953,597

(22) Filed: Nov. 24, 2010

(65) Prior Publication Data

US 2011/0277874 A1 Nov. 17, 2011

Related U.S. Application Data

(60) Provisional application No. 61/334,448, filed on May 13, 2010.

(51) Int. Cl.
*B65B 1/04* (2006.01)
*B65B 31/00* (2006.01)

(52) U.S. Cl.
CPC ..... *B65B 31/00* (2013.01)
USPC ..... 141/3; 141/20; 141/100; 141/105; 141/197; 53/284.5; 53/470

(58) Field of Classification Search
CPC ..... B65B 31/003
USPC ..... 141/3, 20, 44, 50, 59, 65, 100, 105, 141/197, 275; 53/284.5, 470
See application file for complete search history.

(56) References Cited

U.S. PATENT DOCUMENTS 3,157,974 A * 11/1964 Stanley et al. ..... 53/88
3,211,191 A * 10/1965 Honisch ..... 141/20
3,477,195 A * 11/1969 Chambers ..... 53/470
3,545,170 A * 12/1970 Leonard ..... 53/88
3,745,741 A * 7/1973 Cunningham et al. ..... 53/88
3,797,534 A * 3/1974 Skidmore ..... 141/3
3,977,151 A * 8/1976 Reever et al. ..... 53/408
4,872,491 A * 10/1989 Nickason et al. ..... 141/20
4,896,794 A * 1/1990 Banks et al. ..... 222/1
4,913,197 A * 4/1990 Friedrich ..... 141/3
4,938,260 A * 7/1990 Hirz ..... 141/20
5,203,383 A * 4/1993 Turunen ..... 141/20
5,740,841 A * 4/1998 Hirz ..... 141/20
5,832,965 A * 11/1998 Fasse et al. ..... 141/20
6,302,163 B1 * 10/2001 Zeigler ..... 141/20
6,948,534 B1 * 9/2005 Hirz ..... 141/20
7,000,650 B2 * 2/2006 Desjardins et al. ..... 141/20
H002205 H * 11/2007 Andersen et al. ..... 141/20
7,730,911 B2 * 6/2010 Pericard ..... 141/20
8,096,327 B2 * 1/2012 Hirz ..... 141/20

* cited by examiner

*Primary Examiner* — Timothy L Maust
(74) *Attorney, Agent, or Firm* — Fay Sharpe LLP; James E. Scarbrough

(57) ABSTRACT

A pressure filling system for filling aerosol cans with liquid includes an enclosure including a top wall, a bottom wall, and side walls which form a filling chamber. An air operated pump is positioned within the filling chamber. A liquid supply tube extends into the chamber and into the pump. A pressurized air supply tube extends into the chamber and into the pump. A pressurized supply outlet tube which extends from the pump to a filling head in the filling chamber. An air purge tube is connected to the filling head to purge excess air from the liquid. A lifting mechanism lifts an aerosol can into engagement with the filling head for receiving pressurized liquid.

12 Claims, 13 Drawing Sheets

EQUILIBRIUM PRESSURE FILLING METHOD FOR FILLING PRE-PRESSURIZED AEROSOL CANS WITH BARRIER SYSTEM

CLAIM OF PRIORITY

This application claims priority from U.S. Provisional Patent Application Ser. No. 61/334,448 filed on May 13, 2010, which is hereby incorporated by reference in its entirety.

BACKGROUND OF THE DISCLOSURE

The subject disclosure relates to an apparatus for filling and/or transferring fluid or liquid into a fluid container. More particularly, it relates to an equilibrium pressure filling method for filling aerosol cans such as pre-pressurized, dual compartment aerosol cans. It can also be used with cans with a barrier system using a Bag On Valve (BOV). The preferred embodiment of the disclosure is a mechanically operated apparatus for filling fluid into a pressurized fluid container (such as an aerosol can) wherein the fluid container has a "check-valve" type port means which when actuated permits the discharge of fluid under pressure from the container. However, the disclosure could possibly be used in other applications and fields.

There are existing machines and systems for transferring fluid to a fluid container. The field of pressurized fluid containers is more specific and, of course, pressurized containers such as aerosol cans have been used on a world-wide basis for a number of decades. There are many diverse products supplied in aerosol cans and the manufacture of such cans and the filling thereof is highly developed. Current existing aerosol systems require complex machining to be filled and which cannot be refilled. Other existing systems cannot be used at the location of use, thus necessitating product shipping costs. Other existing handheld pump sprayers are heavy and awkward to use. Thus, there exists a need for an easy-to-use spray aerosol can which can be refilled at the location of use.

There also exists a need for an environment friendly equilibrating pressure filling method for filling pre-pressurized aerosol cans which overcomes deficiencies in existing systems while providing better overall results. Specifically, a system which allows cans to be refillable and reusable in a small scale production which lowers costs is desired.

SUMMARY OF THE DISCLOSURE

The present disclosure provides an apparatus which, in one application, permits the refilling of aerosol cans once the original contents have been utilized or used. The present disclosure may be configured in a relatively small, lightweight, portable device or machine.

In accordance with one aspect of the disclosure, a pressure filling system for filling aerosol cans with liquid includes an enclosure comprising a top wall, a bottom wall, side walls and a rear wall connecting the top and bottom walls; wherein the top, bottom, side walls and rear wall form a filling chamber. An air operated pump is positioned within the filling chamber. A liquid supply tube extends into the chamber and into the pump. A pressurized air supply tube extends into the chamber and into the pump. A pressurized supply outlet tube extends from the pump to a filling head which extends from the top wall. An air purge tube is connected to the filling head to purge excess air from the system. A lifting mechanism lifts an aerosol can into engagement with the filling head for receiving pressurized liquid.

In accordance with another aspect of the disclosure, a method of pressure filling an aerosol container includes connecting a liquid supply tube to a liquid connection in a filling apparatus, and to a pump within the filling apparatus; connecting a pressurized air hose to a pressurized air supply and to the pump within filling apparatus; connecting a pressurized liquid supply tube between the pump and a filling head of the filling apparatus; placing an empty aerosol container on a lifting mechanism; lifting the container into contact with the filling head; filling the container with pressurized liquid through the pressurized liquid supply tube; and removing the container from the filling apparatus.

In accordance with another aspect of the disclosure, the filling apparatus includes a metal enclosure which contains an air operated pump, such as a diaphragm pump, a liquid in feed tube, a liquid pressurized output tube, a filling head, a container lifting device and a pressurized air supply hose.

To use the system, a liquid such as spray paint, adhesive, resin or any other product suitable to be used in an aerosol can, is fed into the liquid supply tube. Pressurized air is supplied by a pressurized air supply via a pressurized air supply hose. At this point, an air valve is turned on. Liquid then flows through the pump with pressure into the filling head. A check valve inside the filling head prevents the product from going any further. Air is purged from the system via an air purge valve and hose.

To fill an aerosol container, such as a Bag On Valve (BOV) container, the container is placed on a container lifting device. A lever on the lifting device is then moved or depressed to raise the container into the filling head. Once the top of the container is inserted into the filling head, check valves on both the filling head and the container are actuated which allows the product to flow into the container due to a pressure differential between the filling head and the container. The pump will start to pump and continue to pump the liquid until the pressure inside the container reaches the same pressure as the air pressure being supplied. At that point, the product stops flowing and the process is complete. The container can now be lowered from the container lifting device and used. This process can be repeated as long as the container is intact and reusable.

Another aspect of the disclosure is that the filling system is more environmentally friendly than existing systems.

Another aspect of the disclosure is it allows filling or refilling of specially designed aerosol containers at any location.

Another aspect of the disclosure is that it allows the system to be used at the location of use or any locations where compressed air is available, thus reducing product shipping costs.

Another aspect of the disclosure is that the system can be used with a variety of liquids, including water, solvents, gel, paints, adhesives or resins.

Still another aspect of the disclosure is that the system allows aerosol cans to be refillable and reusable, thus reducing waste of aerosol cans.

Yet another aspect of the disclosure is that the system pressurizes the aerosol can using pressurized air to a pressure of about 60-150 psi.

Still another aspect of the disclosure is it can spray at substantially any angle.

Still another aspect of the disclosure is that the system can be used with containers having Bag On Valves (BOV).

Yet another aspect of the disclosure is it is a completely enclosed system which minimizes leaks or spills.

Still other aspects of the disclosure will become apparent upon a reading of the following detailed description.

DETAILED DESCRIPTION OF THE DISCLOSURE

Figure 1:
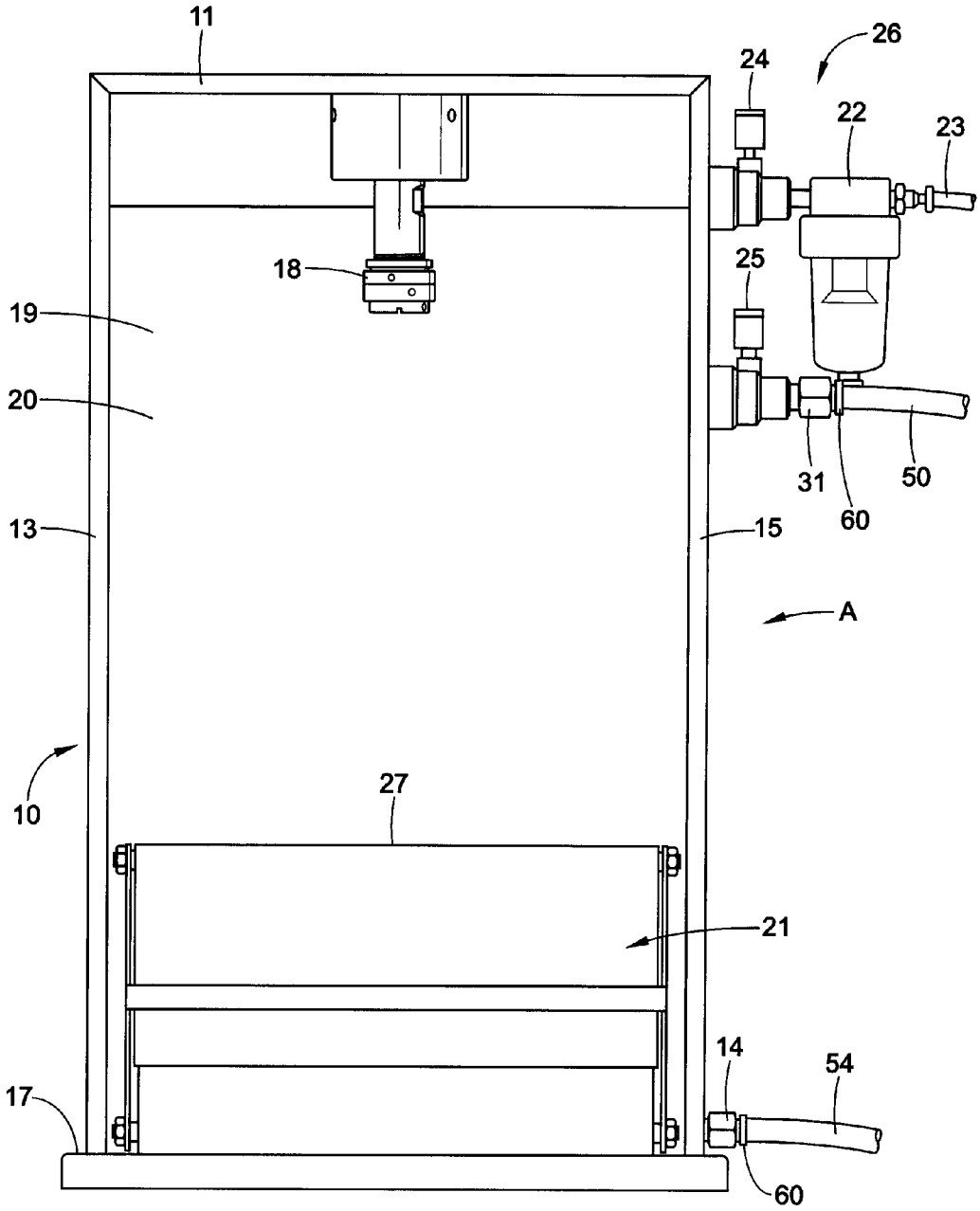
FIG. 1 is a front elevational view of an enclosure for a diaphragm pump and filling head in accordance with a first embodiment of the disclosure.
Figure 2A:
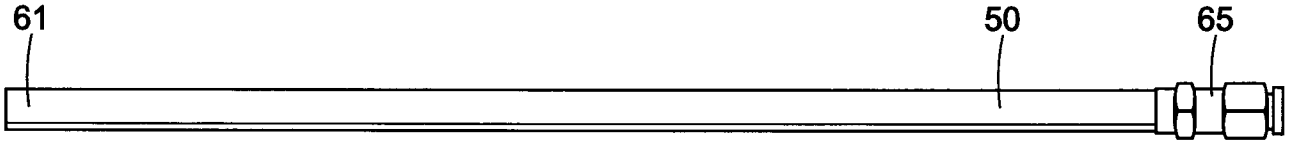
FIG. 2A is a side elevational view of a purge dip feed line in accordance with one aspect of the disclosure.
Figure 2B:
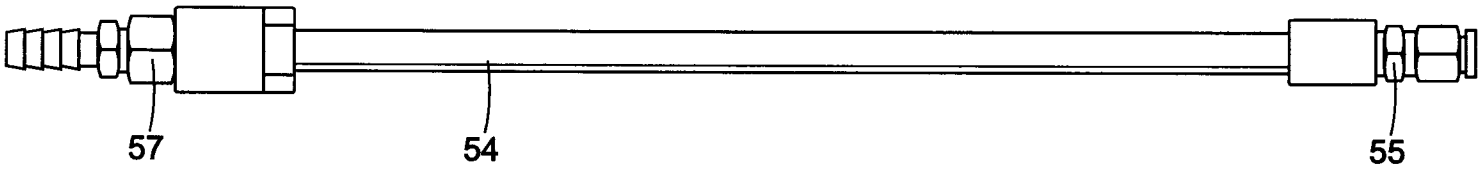
FIG. 2B is a side elevational view of a liquid dip feed line in accordance with one aspect of the disclosure.
Figure 3:
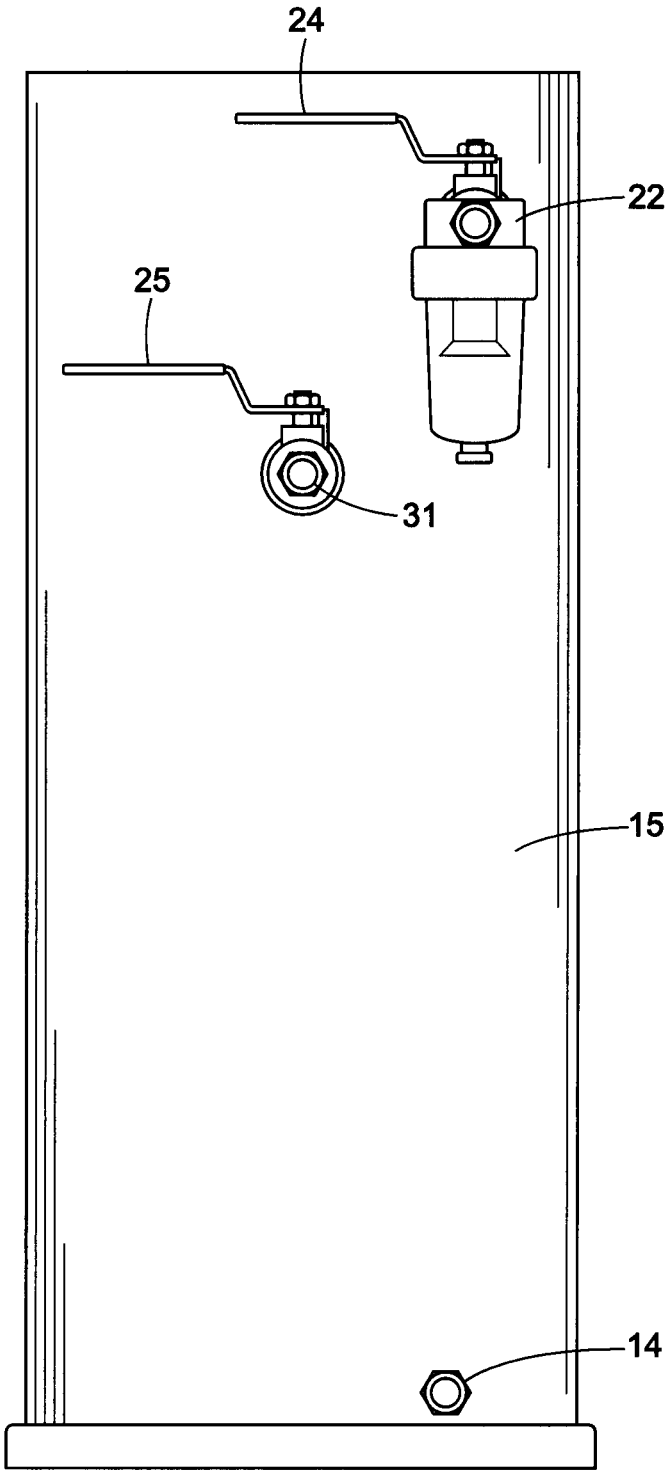
FIG. 3 is a side elevational view of the enclosure of FIG. 1.

Referring to FIG. 1, a mechanically operated apparatus or enclosure A for filling or transferring fluid into a fluid container is provided.

Specifically the present disclosure relates to a pneumatically and mechanically operated apparatus that permits the refilling and reusing of specifically designed aerosol cans once the original contents have been utilized or used. The preferred embodiment shows an aerosol can with a Bag On Valve (BOV), but aerosol cans other than BOV can be used with the system as well. The disclosure allows the BOV aerosol to be filled and refilled with a liquid, such as spray paint, coatings, adhesives or resins to a set pressure up to about 150 psi. Other pressures are also contemplated by the disclosure.

Figure 4:
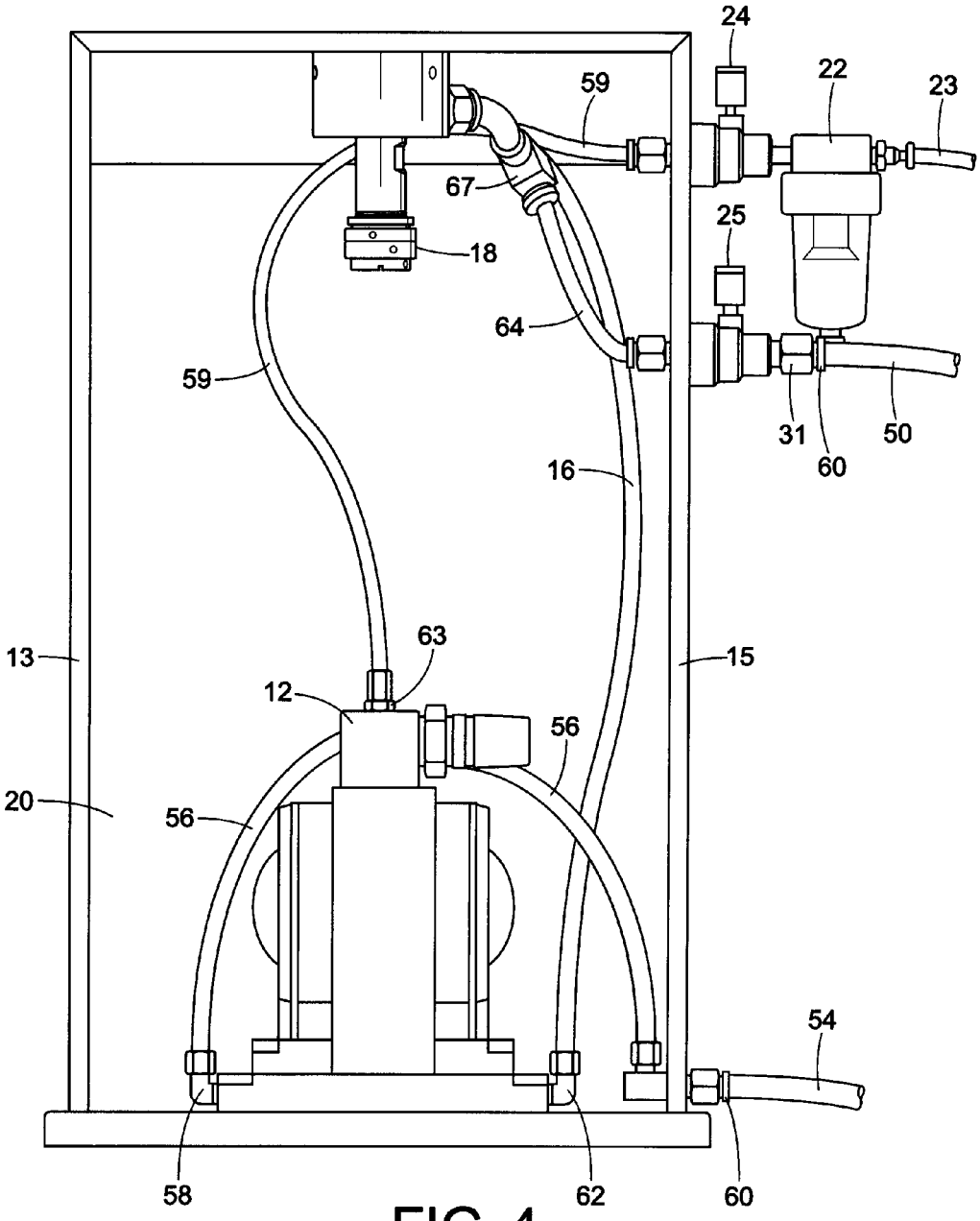
FIG. 4 is a front elevational view of a pump within the enclosure of FIG. 1.
Figure 5:
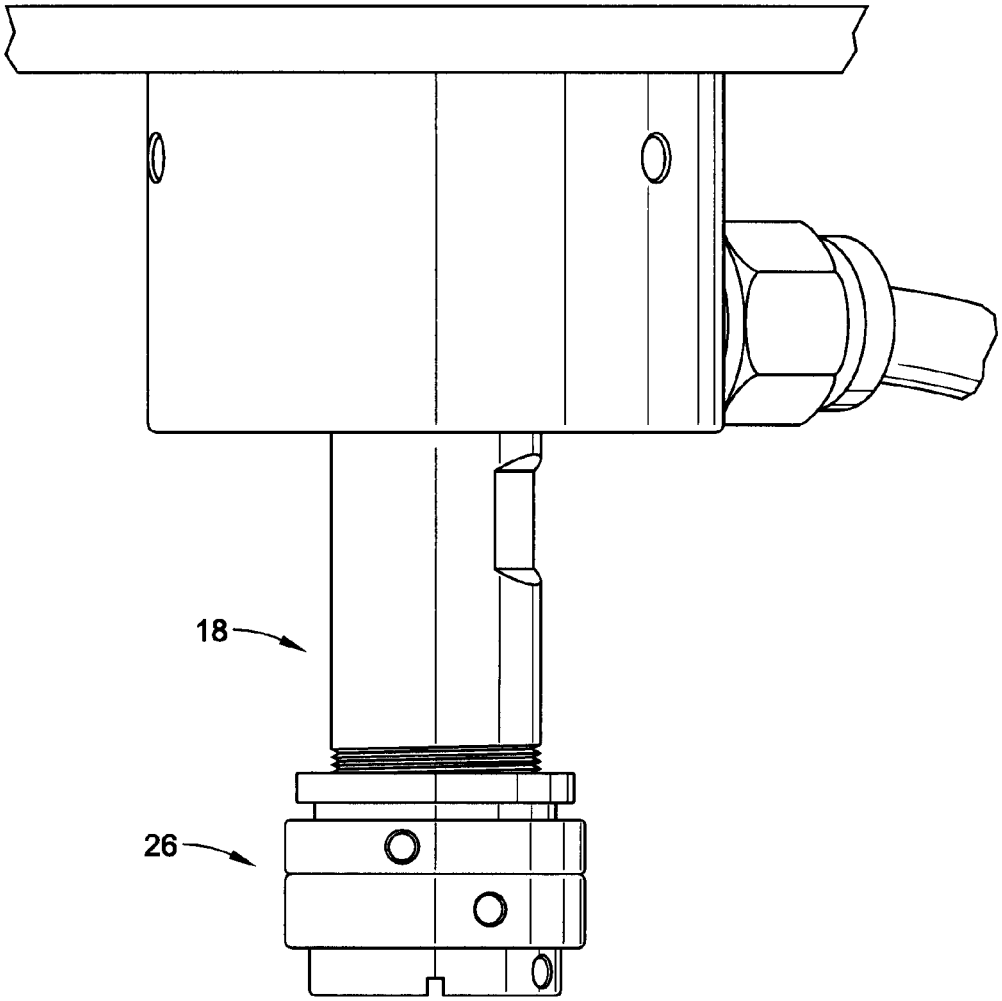
FIG. 5 is an enlarged side elevational view of a filling head of FIG. 1.

Referring specifically now to FIG. 1, the filling apparatus A includes a metal enclosure 10 having a top wall 11, two opposite side walls 13, 15, a rear wall 19 and a bottom wall 17 which together form an internal filling chamber 20. Referring to FIG. 4, chamber 20 includes an air operated diaphragm pump 12, a liquid in feed tube 54 which is connected to a liquid in connection 14 formed near the bottom of wall 15, a liquid pressurized output tube 16 extending from a bottom of pump 12, a filling head 18 extending from top wall 11, a BOV container lifting device 21 (FIG. 8) and a pressurized air supply 26 which extends from an upper portion of side wall 15.

To use the system, a liquid, such as spray paint, gel, solvent, adhesive, or resin is fed into the liquid supply tube 54 via liquid in connection 14 by an external source of liquid such as a pail (not shown). The liquid then enters the pump via tube 56 and pump inlet 58. Pressurized air is supplied to the pump by pressurized air supply via a pressurized air supply hose or tube 23 which passes through air supply filter 22. Pressurized air then enters tube 59 and enters the pump via inlet 63. The compressed air is pressurized to about 80 psi-150 psi. Other pressures are also contemplated by the disclosure. An air supply valve 24 is turned on to allow pressurized air flow to the pump via tube 59. Liquid then flows through the pump 12 via tube 56 and is pressurized via pressurized air flow from tube 59. The liquid then flows under pressure from out of the pump via outlet 62 into the filling head 18 via pressurized product supply outlet tube 16. A "t-shaped" pipe connection 67 is connected to the hose 16 and also to hose 64 to allow purging of excess air via hose 64. A check valve 26 (FIG. 7) inside the filling head 18 controls flow of the liquid into an aerosol can.

Figure 6:
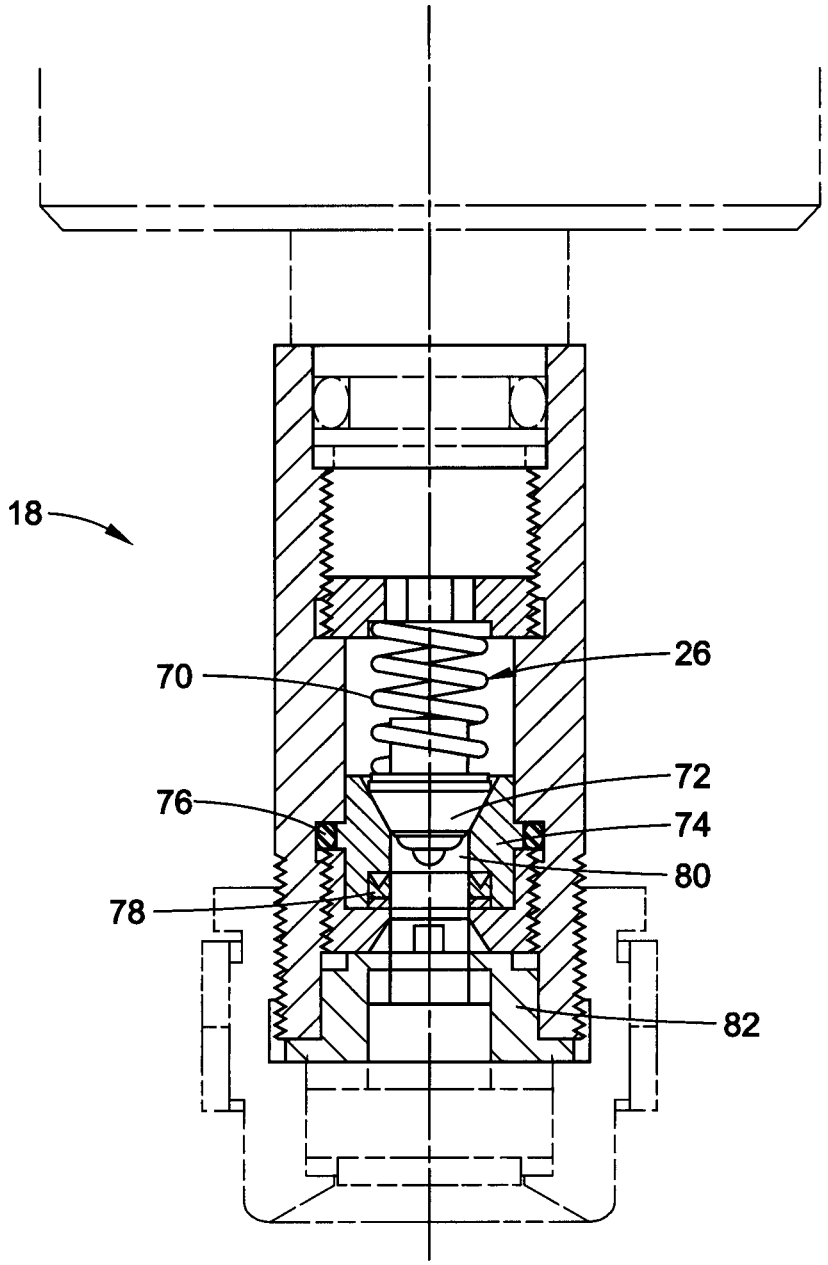
FIG. 6 is a cross-sectional elevational view of the filling head assembly of FIG. 5.
Figure 7:
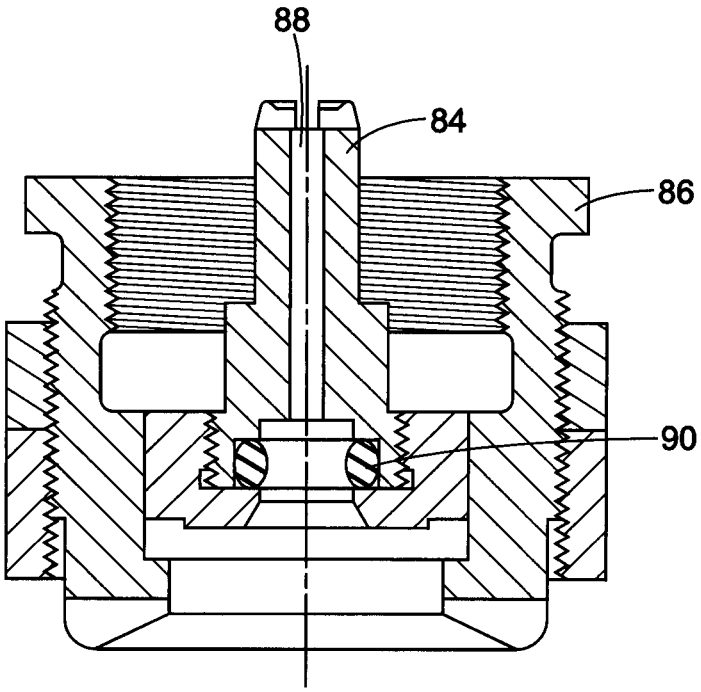
FIG. 7 is a cross-sectional elevational view of a filling head nozzle of FIG. 5.

Referring to FIGS. 6 and 7, the details of filling head 18 and check valve 26 are shown. Referring to FIG. 6, the filling head assembly 18 includes a check valve assembly 26 which includes a spring 70 and a seal 72, such as Teflon® seal, which is biased into a sealed position against inner housing 74. Gasket seals 76, 78 aid in forming a seal around housing 74. Seal 70 is moved upwardly or downwardly based on liquid flow through the valve. When seal 70 moves upward, liquid travels through opening 80 within housing 74. Liquid then flows to filling head insert 82 and into filling head nozzle 84 (FIG. 7) which is housed with filling head housing 86. Nozzle 84 has a central opening 88 through which liquid flows. At a lower portion of the nozzle are gasket seals 90 to prevent flow of liquid therethrough.

Excess air in the liquid is purged from the apparatus via purge connection 31 and hose 64 connected to head 18 (FIGS. 4 and 6) and external hose 50. An air purge valve check 25 controls the flow of excess air from the system.

Figure 8:
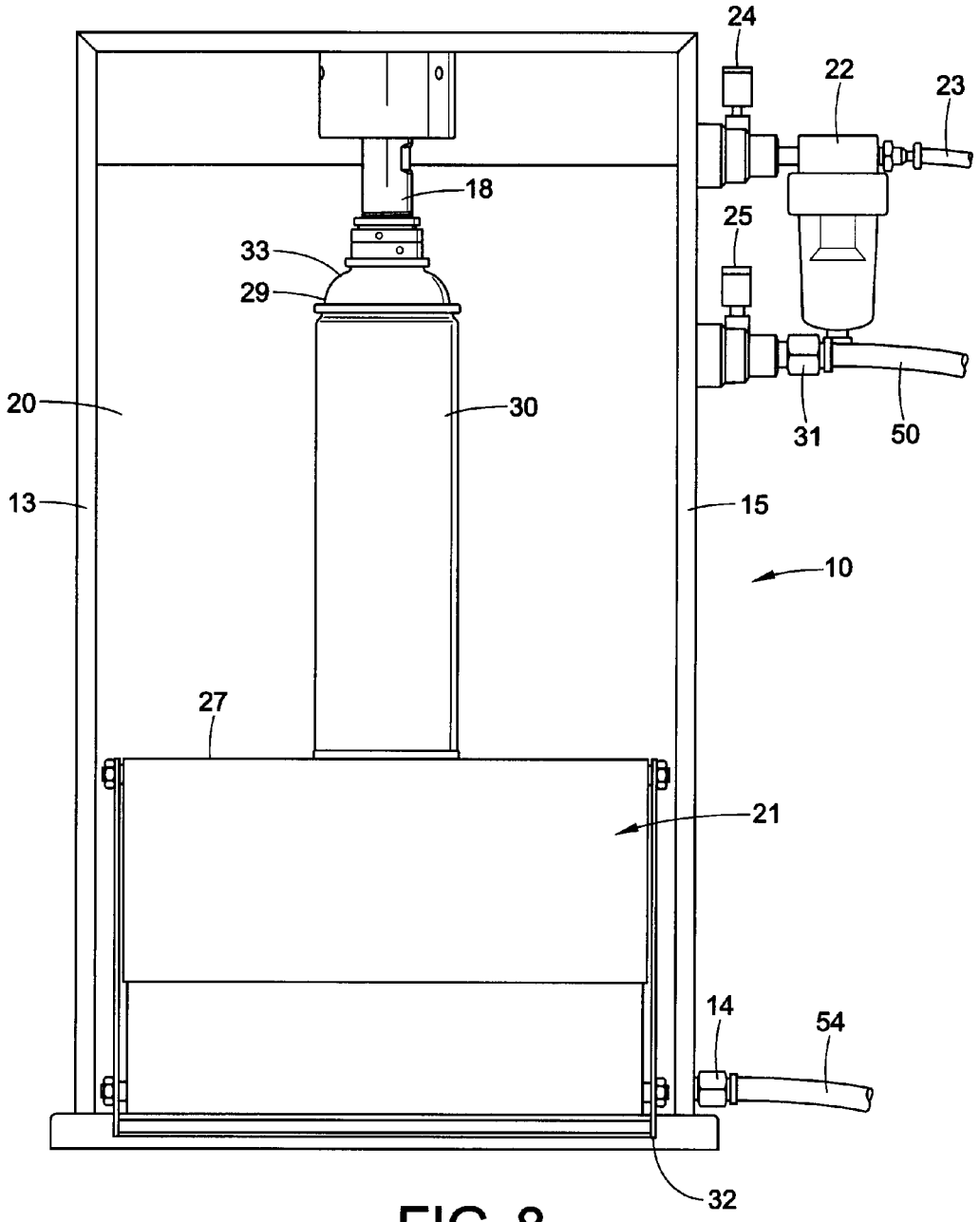
FIG. 8 is a front elevational view of a container within a container lift device including a lift lever.

Referring now to FIG. 8, to fill an aerosol (BOV) container 30 with pressurized liquid, the container is placed on the container lifting device or filling pedestal 21. Container lift device 21 includes a platform or shelf 27 which serves as a refilling pedestal. A lever 32 on the lifting device is pressed to raise the pedestal 21 and container 30 until a top wall 33 of the container engages the filling head 18. The top portion 33 of the BOV container 30 is then inserted into the filling head. Check valves 26, 29 on both the filling head and the BOV container are then actuated which allows the liquid to flow into the BOV container 30 from filling head 18 due to a pressure differential that is formed between the filling head and the container. The pump 12 will start to pump and continue to pump the liquid via tube 16 until the pressure inside the BOV container reaches the same pressure as the air pressure being supplied via tube 16; that is, about 60-150 psi. When the pressures in the container 30 and in tube 16 are essentially equal, the liquid stops flowing and the process is complete and the container is substantially full of pressurized liquid. The BOV container is then lowered from the container lifting device and is ready for use. This process can be repeated as long as the BOV container is intact and can be reused.

Figure 9A:
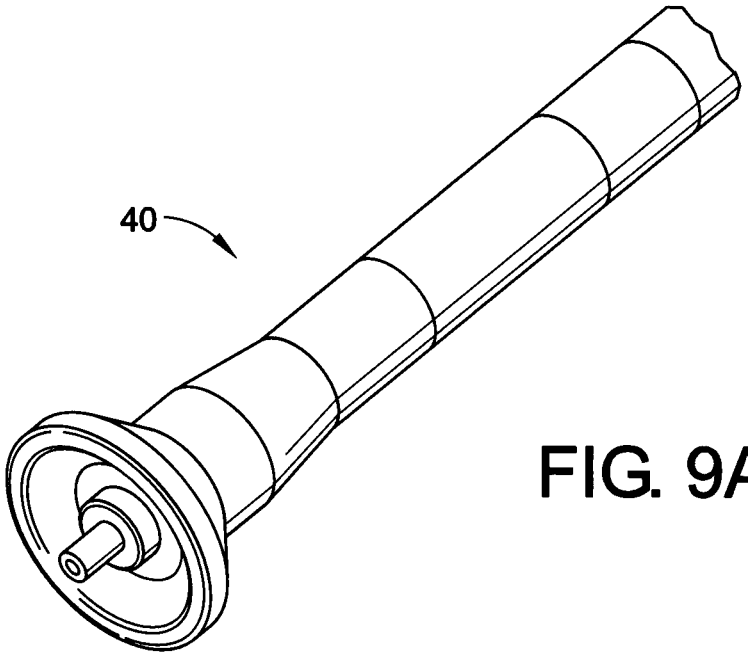
FIG. 9A illustrates a male Bag On Valve (BOV)
Figure 9B:
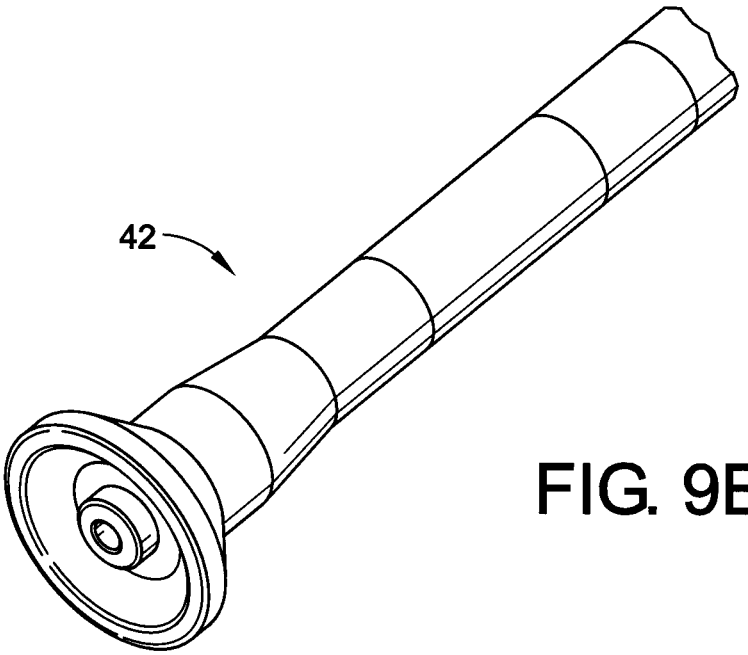
FIG. 9B illustrates a female Bag On Valve (BOV)

Referring now to FIGS. 9A and 9B, the specifics of the Bag On Valve (BOV) container are shown. Male and female Bag On Valves 40, 42 are shown in FIGS. 9A and 9B, respectively. The male Bag On Valve 40 is the more commonly used valve.

Figure 10:
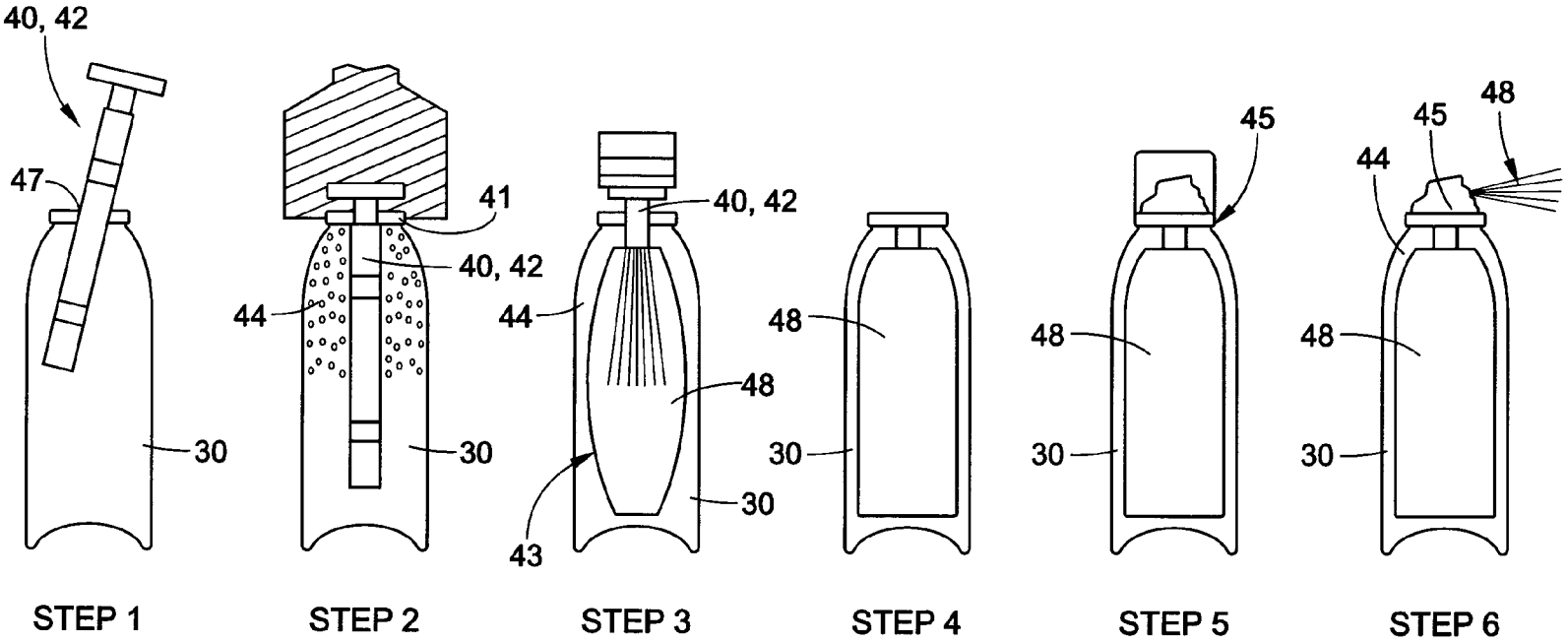
FIG. 10 is a schematic illustration of a Bag On Valve container.

Referring to FIG. 10, the steps involved with assembling a BOV container are shown. In step 1, a bag is attached to the valve 40, 42, after which the BOV 40, 42 is inserted into the can or container 30 via opening 47. In step 2, propellant such as compressed air is under-the-cup pregassed into the can and the valve 40, 42 is crimped to the top 41 of the can. In step 3, product 48 such as spray paint or adhesive or resins is then pressure filled through the valve 40, 42 into bag 43. The pressurization agent, preferably either compressed air or nitrogen 44, surrounds the product-filled pouch. In step 4, weight and/or pressure control and water bathing of the container occurs. In step 5, an actuator and cap 45 are fitted to the container.

In step 6, when the actuator 45 is depressed, the air exerts pressure on the pouch, providing the force required to discharge product 48 through the cap.

All the air preferably remains in the container and is not released into the atmosphere.

Figure 11:
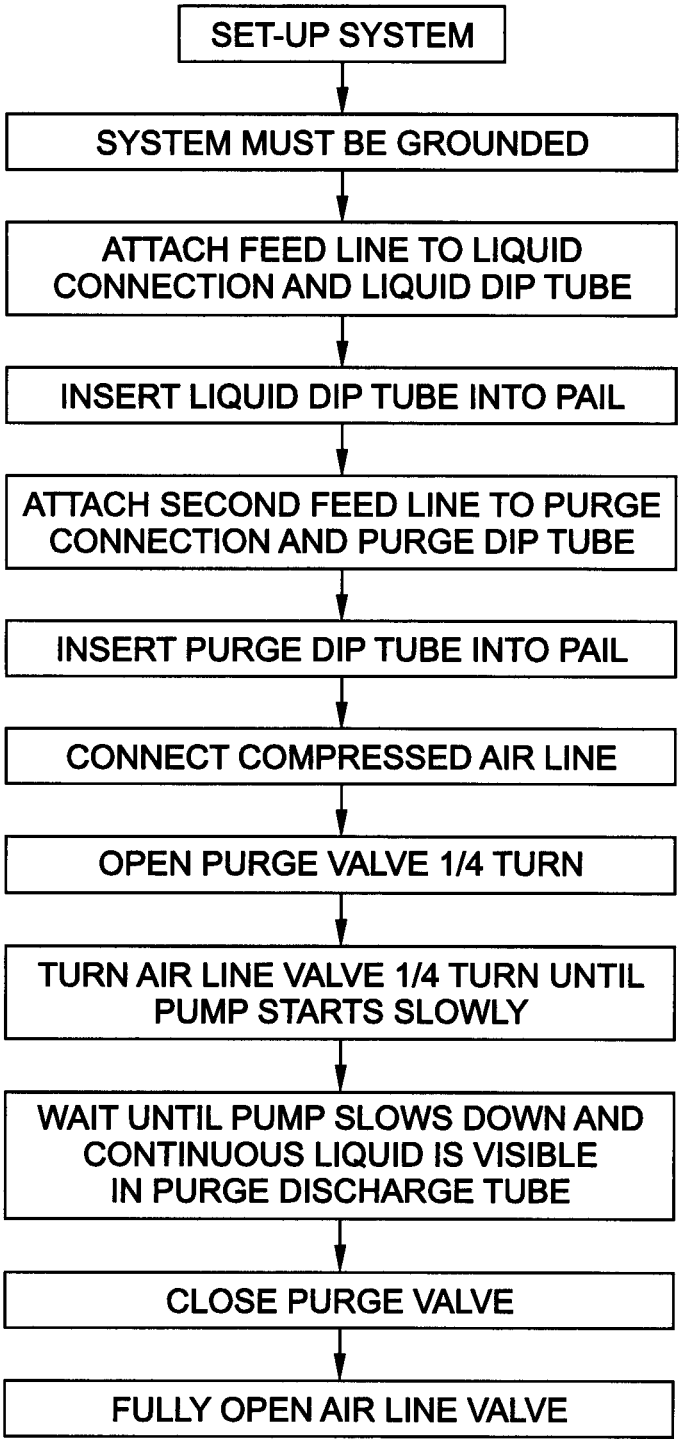
FIG. 11 is a schematic flow chart illustrating the steps for setting up the system for filling aerosol cans.

Referring to FIG. 11, setting up the filling system for refilling and pressurizing an aerosol spray can requires the following steps. First, the system must be grounded. Second, a first end 55 of a liquid in feed line or tube 54 is attached to a liquid connection 14. The other end 57 of the feed tube 54 is inserted into a pail (not shown). Any conventional water pail or liquid holding container can be used. A second feed line or tube 50 is attached to a purge connection 25 at a first end 65. A second end 61 of the feed line or tube 50 is inserted into a pail (not shown).

A compressed air supply line or hose 23 is then connected to the pressurized air line supply. The air purge valve 25 is opened about a quarter (¼) turn. The air supply valve 24 is turned about a quarter (¼) turn until the pump 12 starts operating slowly. When the pump action slows down, and continuous liquid is visible in the discharge or purge tube, the purge valve 25 is then completely closed. The air line valve 24 is then fully or completely opened. The filling system is now ready for use.

Figure 12:
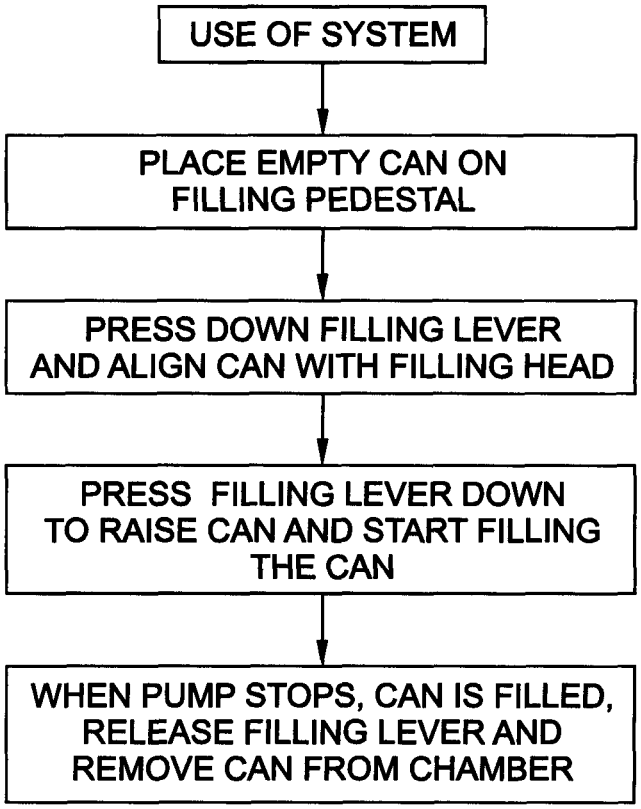
FIG. 12 is a schematic flow chart illustrating the steps for using the system for filling aerosol cans.

Referring to FIG. 12, the following steps are involved with activating using the refillable aerosol system. First, an empty refillable aerosol can or container 30 is placed on the filling pedestal 21. Filling lever 32 is slowly pressed down while raising and aligning the aerosol can 30 with the filling head 18. Once the aerosol can is aligned with the filling head, the filling lever 32 is pushed all the way down to start the pump 12 and the filling procedure. The user should be able to hear the system pumping liquid into the aerosol can 30 via tube 16. Once the pump 12 has stopped, the aerosol can 30 is filled. The filling lever 32 is then released and the aerosol can is carefully removed from the filling chamber. The can 30 is ready for use.

Figure 13:
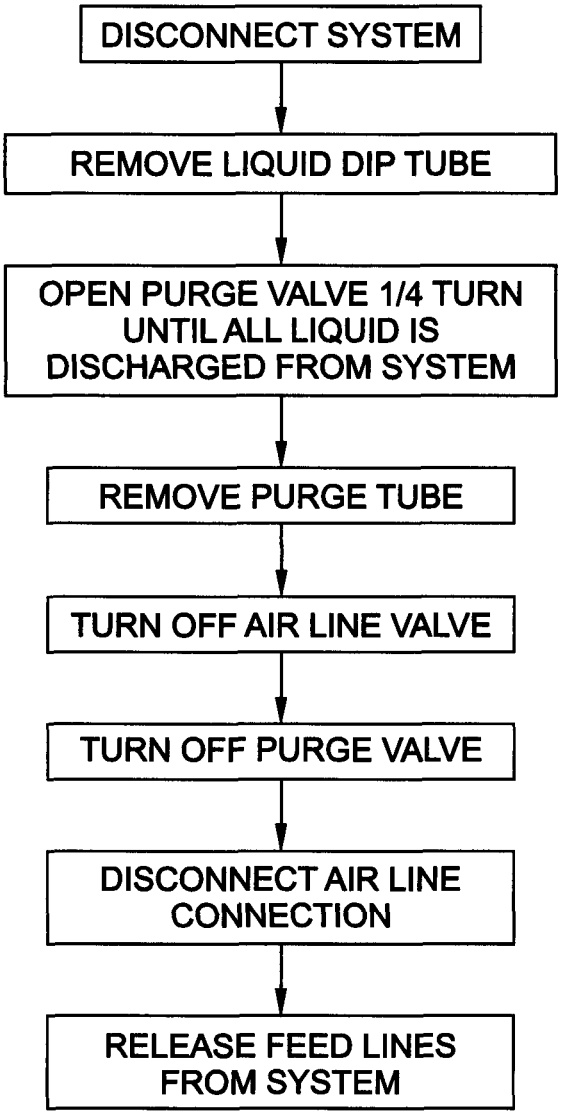
FIG. 13 is a schematic flow chart illustrating the steps for disconnecting the system for refilling aerosol cans.

Referring to FIG. 13, to disconnect the filling system, the liquid dip tube 50 is removed from the pail. The purge valve 25 is opened about a quarter (¼) turn until no more liquid is released from the purge dip tube 54. The purge valve 25 is closed. The air line valve 24 is turned to an "off" position. Next, the air line connection and tube 22, 23 are disconnected. The feed lines 50, 54 are removed from the purge connection 31 and liquid connection 14, respectively. Rings 60 are depressed or pushed down to release the feed lines 50, 54 from the system.

The exemplary embodiment has been described with reference to the preferred embodiments. Obviously, modifications and alterations will occur to others upon reading and understanding the preceding detailed description. It is intended that the exemplary embodiment be construed as including all such modifications and alterations.

The invention claimed is:

1. A pressure filling system for filling aerosol cans with liquid, comprising:

an enclosure comprising a top wall, a bottom wall, a rear wall and side walls connecting said top and bottom walls;

wherein said top, bottom, rear and side walls form a filling chamber;

a pressurized air hose connected to a pressurized air supply and to a pump positioned within said filling chamber;

wherein said pump pumps liquid directly into said aerosol can until pressure in said aerosol can is always substantially and simultaneously equal to pressure of said pressurized air supply for each pressure of said pressurized air supply;

a liquid supply tube extending into said chamber and into said pump;

a filling head which is connected to and extends from the top wall;

a pressurized supply outlet tube which extends from said pump to said filling head;

an air purge tube connected to said filling head to purge excess air from said liquid; and a platform for lifting an associated aerosol can into engagement with said filling head for receiving pressurized liquid; and a lever which is used to raise said platform and said aerosol container into contact with said filling head.

2. The system of claim 1, wherein said aerosol can is a Bag On Valve can.

3. The system of claim 1, wherein said pump comprises an air operated diaphragm pump.

4. The system of claim 1, wherein said pressurized air supply tube supplies air to said pump that is pressurized to about 60 psi to 150 psi.

5. The system of claim 4, further comprising an air supply valve for controlling flow of pressurized air.

6. The system of claim 1, wherein said filling head comprises a check valve to control flow of liquid into an aerosol can.

7. The system of claim 1, further comprising a check valve for controlling flow of excess air from said system.

8. A method of pressure filling an aerosol container, comprising:

connecting a liquid supply tube to a liquid connection in a filling apparatus, and to a pump within said filling apparatus;

connecting a pressurized air hose to a pressurized air supply and to said pump within filling apparatus;

connecting a pressurized liquid supply tube between said pump and a filling head of said filling apparatus;

placing an empty aerosol container on a lifting mechanism;

lifting said aerosol container into contact with said filling head by depressing a lever;

pumping liquid via said pump directly into said aerosol can until pressure in said aerosol can is always substantially equal to pressure of said pressurized air supply at the same time regardless of said pressure of said pressurized air supply;

filling said container with pressurized liquid through said pressurized liquid supply tube; and removing said container from said filling apparatus.

9. The method of claim 8, wherein said pressurized air supply tube supplies air to said pump that is pressurized to about 60 psi to 150 psi.

10. The method of claim 9, further comprising an air supply valve for controlling flow of pressurized air.

11. The method of claim 8, wherein said filling head comprises a check valve to control flow of liquid into an aerosol can.

12. The method of claim 8, further comprising a check valve for controlling flow of excess air from said system.

* * * * *